362-113 SR
7/25/78 XR 4,102,059

United States Patent [19]

Kimble et al.

[11] 4,102,059

[45] Jul. 25, 1978

[54] SMALL ARMS LASER TRAINING DEVICE

[75] Inventors: Joe W. Kimble, Vienna, Va.; Duane A. Burchick, Greenbelt, Md.; Edsel E. Dotson, Alexandria, Va.

[73] Assignee: Cerheronics Inc., Falls Church, Va.

[21] Appl. No.: 710,676

[22] Filed: Aug. 2, 1976

Related U.S. Application Data

[62] Division of Ser. No. 564,861, Apr. 3, 1975, Pat. No. 3,995,376.

[51] Int. Cl.[2] ..... G09B 9/00

[52] U.S. Cl. ..... 35/25; 273/101.1; 362/113

[58] Field of Search ..... 35/25; 273/101.1; 240/6.41; 362/110–114

[56] References Cited

U.S. PATENT DOCUMENTS

| | | | |
|---|---|---|---|
| 1,215,171 | 2/1917 | Lewis | 273/101.1 |
| 3,633,285 | 1/1972 | Sensney | 35/25 |
| 3,657,826 | 4/1972 | Marshall et al. | 35/25 |
| 3,870,305 | 3/1975 | Harclerode | 273/101.1 |
| 3,898,747 | 8/1975 | Marshall | 35/25 |

*Primary Examiner*—Robert W. Michell
*Assistant Examiner*—Arthur S. Rose
*Attorney, Agent, or Firm*—Gipple & Hale

[57] ABSTRACT

A miniaturized laser assembly is mounted on a weapon with the power source and circuitry for the laser assembly being contained within the weapon with no significant visual or actual weight change in the weapons original characteristics. The laser weapon is fired in a normal manner by squeezing the trigger while aiming at the target. The laser emits a harmless invisible signal pulse of coherent light so that if the weapon is aimed correctly a detector indicator unit mounted on a target receives and processes the laser pulse to cause an audible sound signifying that a hit has been registered.

10 Claims, 11 Drawing Figures

Fig I

Fig 8
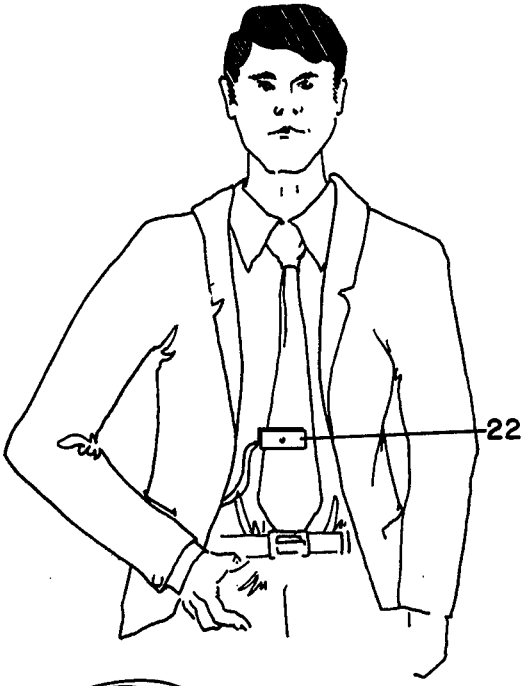
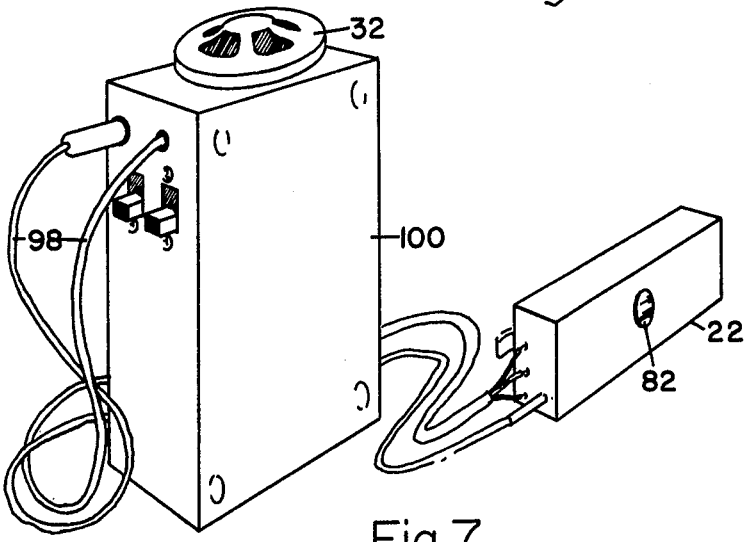
Fig 7

SMALL ARMS LASER TRAINING DEVICE

This is a division, of application Ser. No. 564,861 filed Apr. 3, 1975, now U.S. Pat. No. 3,995,376.

BACKGROUND OF THE INVENTION

The present invention relates to a weapon utilized for marksmanship training and more particularly to a laser small arms firing system for use in small arms training.

Several U.S. Patents have disclosed the use of a portable hand held laser weapon for actual combat use and for training purposes. U.S. Pat. No. 3,404,350 discloses a portable laser system placed in a pistol configurated housing with an aiming telescope. The apparatus taught by this particular patent emits a laser beam which is powered from a battery located outside of the weapon housing. U.S. Pat. No. 3,335,934 also discloses the general concept of utilizing a laser in a pistol. U.S. Pat. Nos. 3,404,305, 3,454,898 and 3,478,278 disclose the use of lasers in connection with rifles or carbines.

A rifle training device is disclosed by U.S. Pat. No. 3,792,535. In this patent a cumbersome high voltage laser system including a transmitter, receiver and hit indicator is mounted to a rifle barrel. A retroreflective means is provided in a target used with the rifle to indicate that the target had been hit with the laser beam.

Another U.S. Pat. No. 3,447,033 discloses a training device used on a tank in which a laser unit is mounted on the gun barrel of the tank with the power supply for firing the laser unit being contained in a housing which is mounted on the tank. The laser beam is fired at a target provided with a reflective surface which when hit by the laser beam produces a flash resembling that of a projectile hit.

It is also known in the art to use light beams in shooting galleries and other amusement areas to fire at darkened targets containing photosensitive cells. A typical such application is shown in U.S. Pat. No. 3,220,732 in which a strobe light with suitable optics is mounted in the barrel of a gun and is activated by a trigger switch which is connected to circuitry and a power source mounted in the barrel of the gun. In this patent the target has a photoelectric cell mounted therein which is energized when impinged by a light source to activate a solenoid so that the target is displaced from its original position indicating that a hit has been scored.

While the above disclosed prior art does show the use of laser weapons and light sources for simulation of small arms firing, none of these weapons provides a safe realistic simulation of an actual firing of a weapon and quick determination of whether the target is hit nor can they be used to fire blank or live ammunition.

One of the inherent dangers associated with laser implementation, is possible eye damage including burns which occur under collimated radiation from an intense point source. The present invention eliminates this problem via the low output power of the selected laser and the optics employed to direct the beam. Thus the system is safe from eye damage in a man-against-man combat scenario. Calculation of eye damage irradiance shows that this system is completely safe and that the threshold of eye damage can be approached only if the operator holds the laser optics directly in front of his eye and fires directly into the pupil.

The present invention besides its important safety aspects provides a highly realistic simulation of the use of small arms allowing law enforcement scenarios or war game exercises to be played out as the weapon can utilize normal blank ammunition. The blank ammunition is provided for any particular caliber of weapon and is used in combination with the laser pulse which is simultaneously fired with the blank. Individuals or targets have a portable detector mounted thereon so that an audible or visual signal is activated if the pulse strikes the sensor element. It should be particularly noted that the present invention is significant because it can be used in artificial light or broad daylight without fear of non-laser simulation of the sensor cell worn by the individual.

The weight of the laser weapon is almost identical with the original weight of the factory small arms weapon so that the laser weight addition is negligible, with the weapons overall balance being maintained along with its original mechanical strength. The CMOS integrated circuit and pulse electronics of the laser consume less than two milliamperes so that the internally contained batteries have a long life.

The laser adapted weapon is completely portable and its circuitry and power source is entirely housed within the weapon stock or batt grips. The laser unit is also easily adapted to any standard weapon.

The laser adapted weapon is designed to be used with blanks, it can be used with live ammunition as well as for "dry fire" exercise to reduce training costs. This multiple capability allows the trainee to accurately detect the weapons's aiming point without firing a round and increases his attention to the instructors instructions. Thus during the early training period the number of costly rounds which would normally be fired to achieve a specified level of marksmanship are greatly decreased. Another cost factor which must be taken into account is the target costs for pop up and other moving targets which can be reused with the present invention.

Since the power supply and supply circuitry is entirely contained in the weapon and the target detector can be carried on the individual who is connected with the particular scenario or war game, realism is added to the exercise.

Thus it can be seen that the function modularity, three dimensional mechanization, packaging, component selection, low power drain, light weight and performance meet all of the requirements for a low cost effective training weapon.

SUMMARY OF INVENTION

A miniaturized laser optics module is mounted on the weapon and a detector indicator unit is mounted on the target. The power source and circuitry for the weapon are contained within the weapon with no significant visual or actual weight change in the weapons original characteristics. The laser revolver or rifle is fired in a normal manner by squeezing off a shot while aiming at the target which causes the laser optics module to emit a harmless invisible single pulse of coherent light. The pulse of laser light is focused on a circle at the target and if the weapon is aimed correctly the detector indicator unit of the target receives and processes the laser pulse to cause an audible sound signifying that a hit has been registered. Thus both the trainee and the instructor know when the weapon was aimed accurately and fired in a correct manner.

Other features and advantages of the invention will be apparent from the following description of the embodiments of the invention as shown in the accompanying drawings.

BRIEF DESCRIPTION OF THE DRAWINGS

FIG. 7 discloses a perspective view of the hit indicator power module and the clasp laser detector of the invention;

FIG. 8 is a perspective view of the detector box and hit indicator power module as worn by an individual;

DETAILED DESCRIPTION OF THE INVENTION

Figure 1:
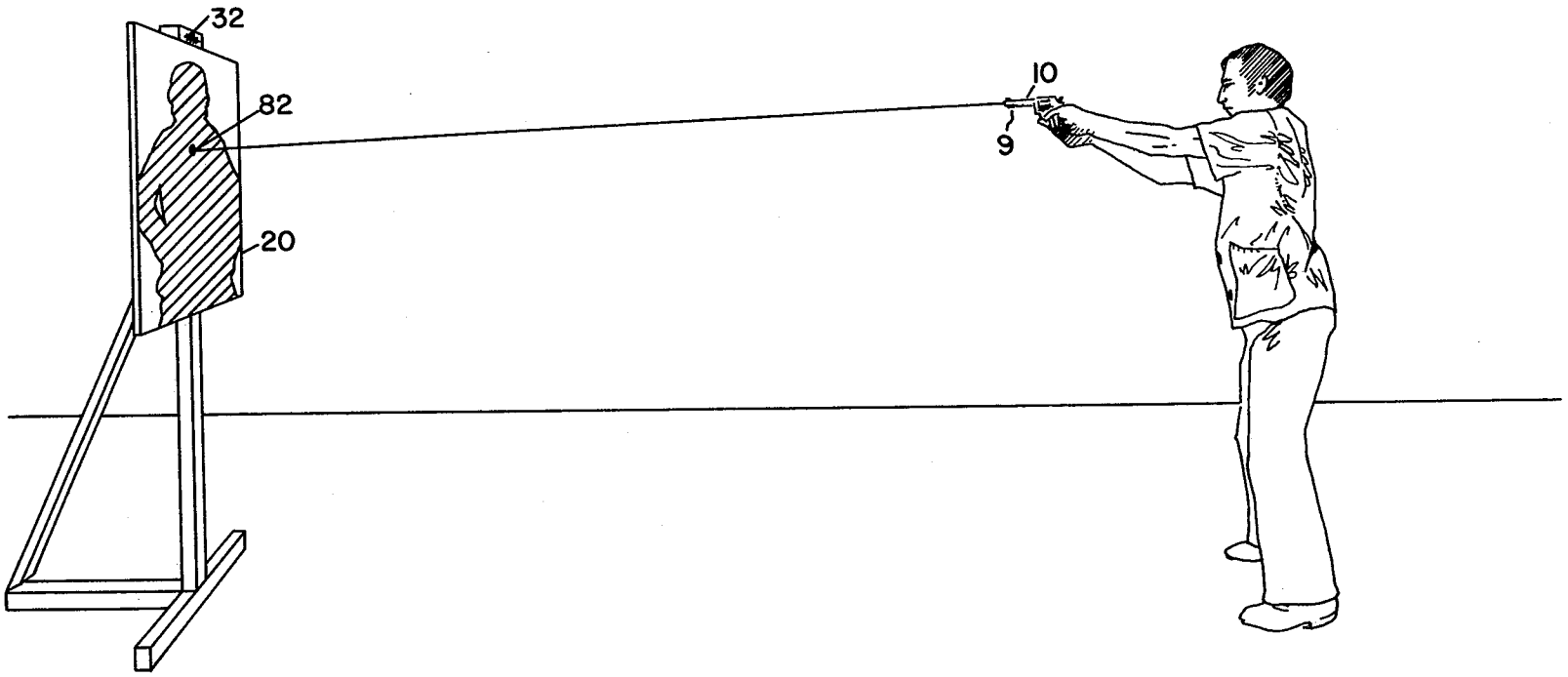
FIG. 1 discloses a perspective view of the invention showing the laser weapon fired at a detector indicator target.
Figure 2:
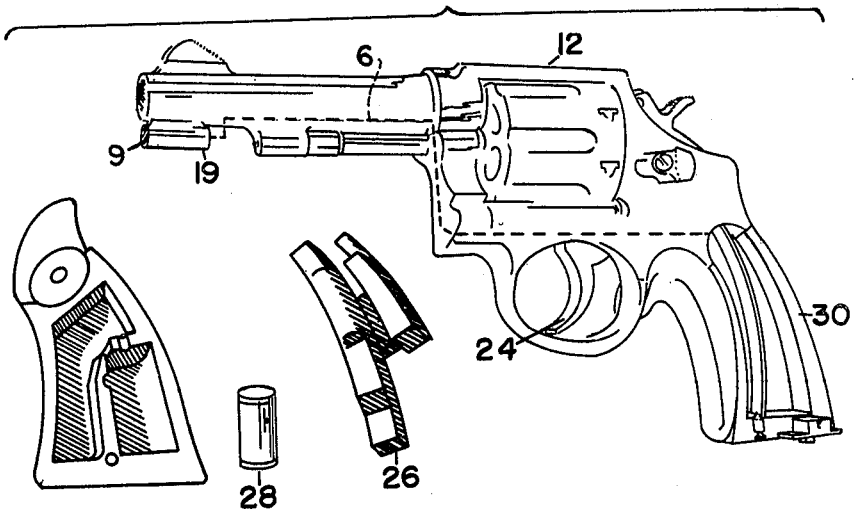
FIG. 2 discloses an enlarged exploded perspective view of the pistol shown in FIG. 1 showing the pulser electronics module, batteries and switches as mounted in the weapon.
Figure 3:
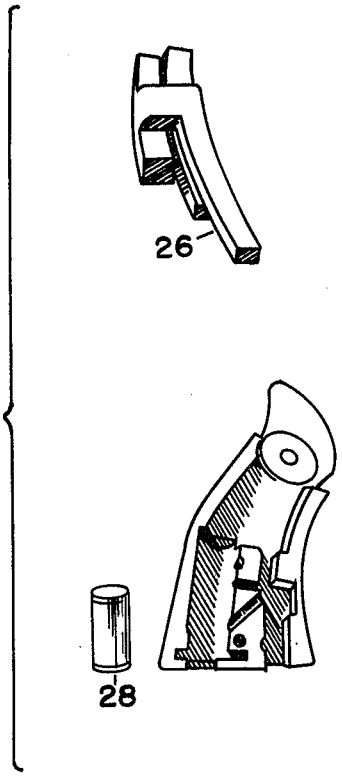
FIG. 3 is another perspective view of the pulser electronics module, shown in FIG. 2.

The system as illustrated in FIGS. 1 through 11 discloses an actual weapon 10 currently in production and use. The weapons shown are a model 10 Smith and Wesson revolver 12 in FIG. 2 and a M 16 rifle 13 in FIG. 11.

Figure 6:
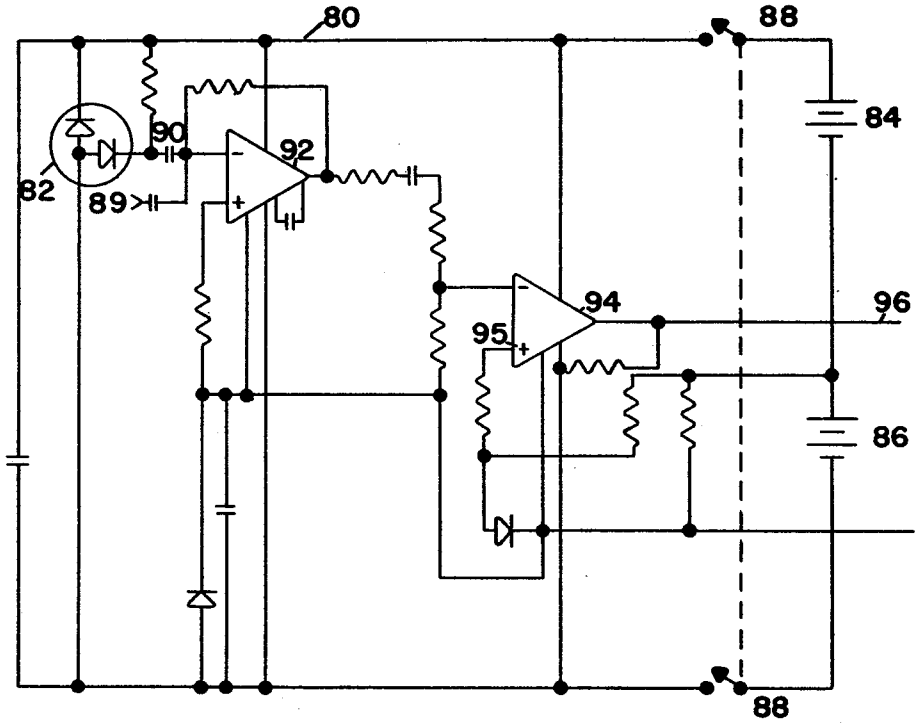
FIG. 6 discloses a schematic drawing of the detector circuitry.
Figure 9:
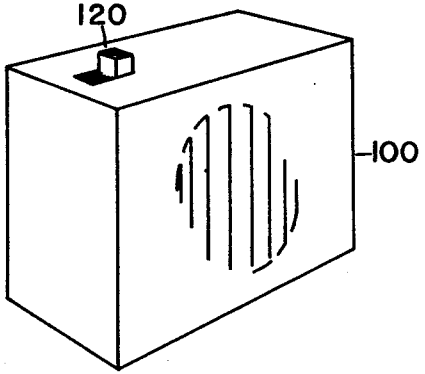
FIG. 9 is a perspective view of the hit timer indicator of the invention.
Figure 10:
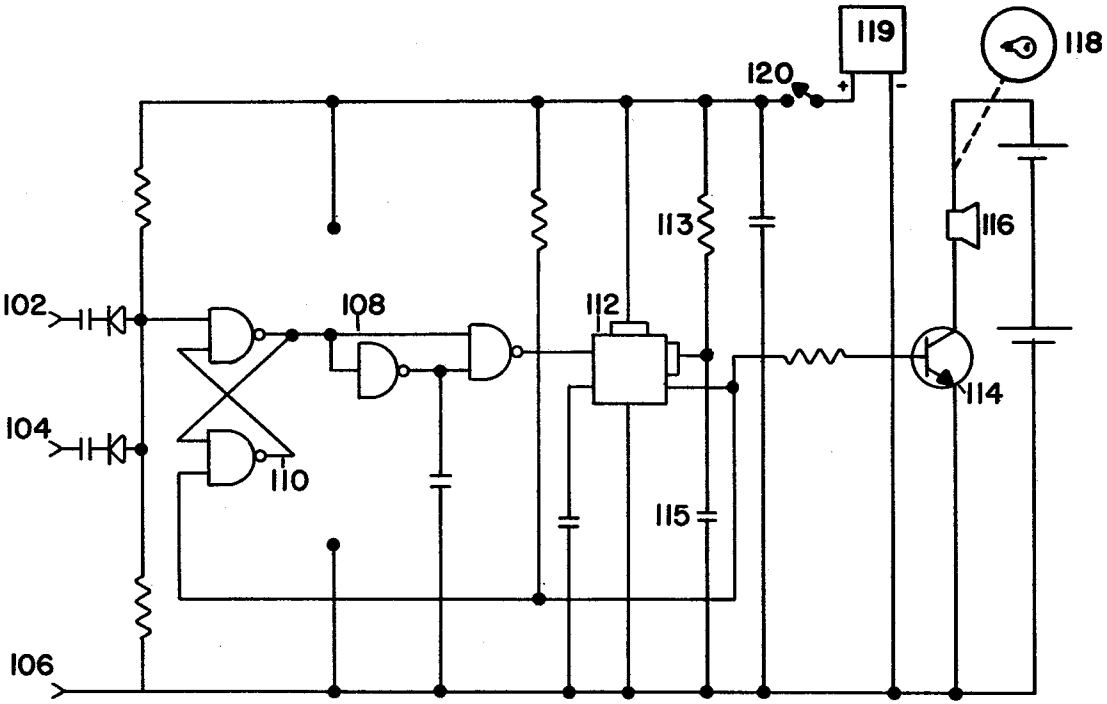
FIG. 10 is a schematic drawing of the hit timer indicator circuit.
Figure 11:
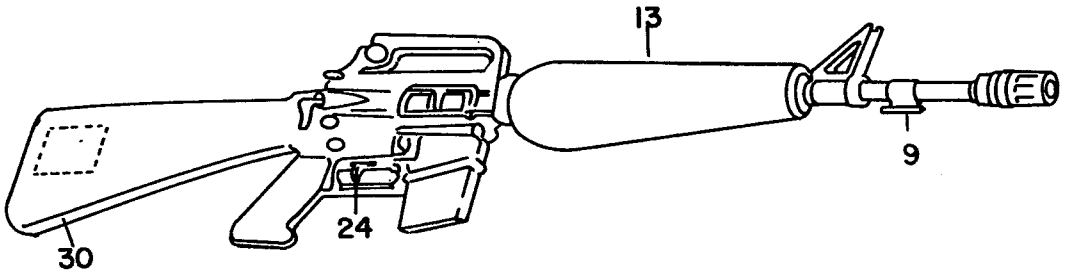
FIG. 11 is a perspective view of a laser rifle invention embodying the circuitry previously disclosed as used with the pistol.

It should be noted that the presently identified weapons are for illustrative purposes only and it is envisioned that any weapon can be outfitted with the present invention. The weapon 10 shown in FIG. 1 is adapted to be fired in a normal manner; i.e., by squeezing off a round while aiming at the target. When the weapon 10 is fired, an invisible pulse of coherent light is emitted from a laser optics module 9 toward a silicon photodiode 82 mounted on a stationary, moving or pop up target 20 or a personally worn target 22 as shown in FIG. 6. Upon being struck by the pulse of laser light the silicon photodiode 82 is activated and the circuitry connected to the photodiode 82 energizes a horn 32 indicating that the shot was successfully aimed and fired. It should be noted at the outset that a lamp or other signal device can be substituted for the horn 32 if such is desired.

When the trigger 24 is pulled the weapon operates in a normal manner in that the firing pin engages a blank cartridge in the weapon causing an explosion and recoil similar to that experienced when one fires real bullets. Simultaneously the trigger 24 operates switch 5 which activates the pulser electronics module 26 with attached batteries 28 which are mounted in the handle or stock 30 via connecting circuitry depicted in FIG. 2 by the dotted line 6 so that a pulse of light is emitted from the laser optics module 9 at the target 20 of FIG. 1.

Figure 4:
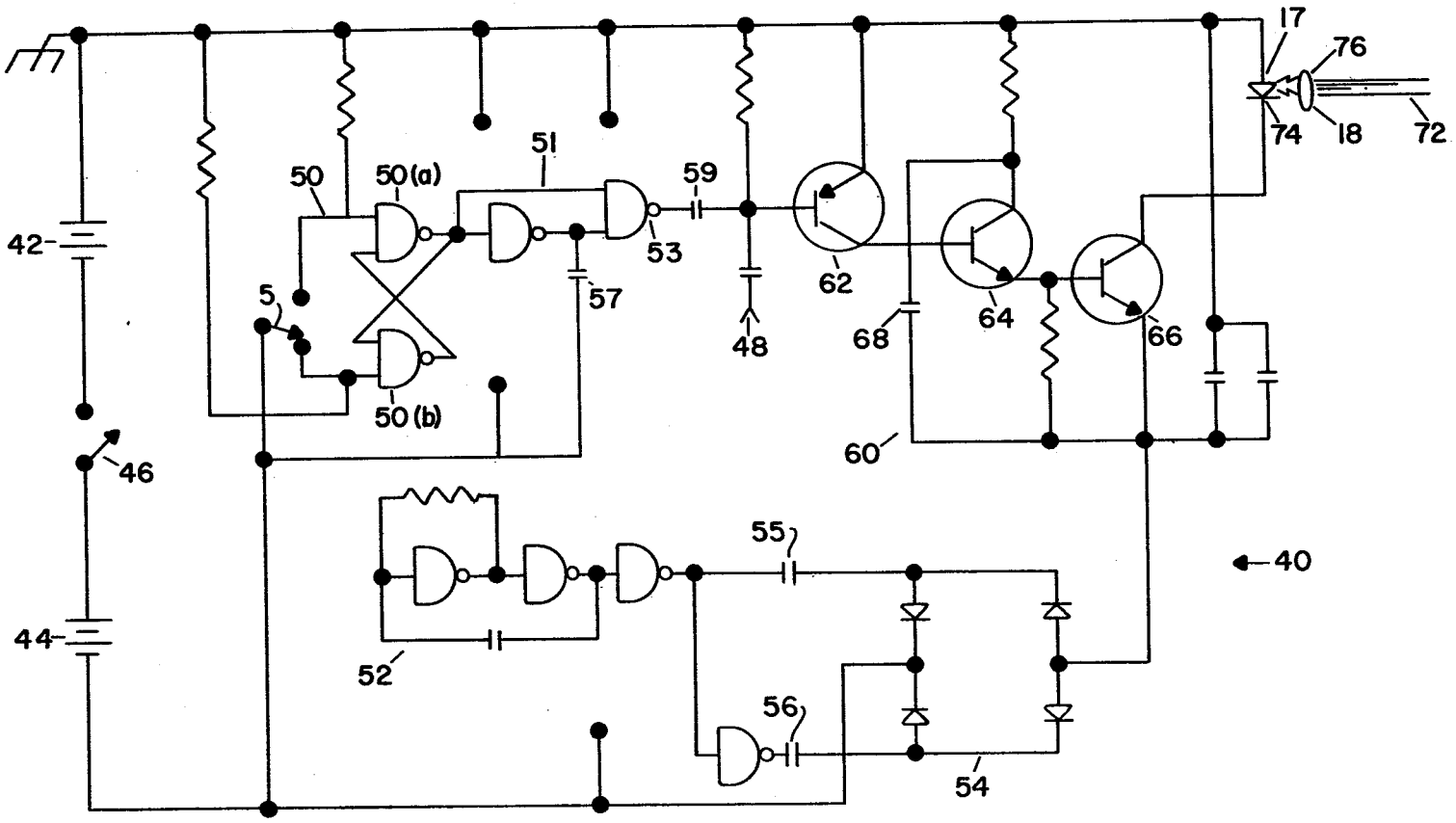
FIG. 4 is a schematic view of the pulser module circuitry and the laser optics module of the pistol.
Figure 5:
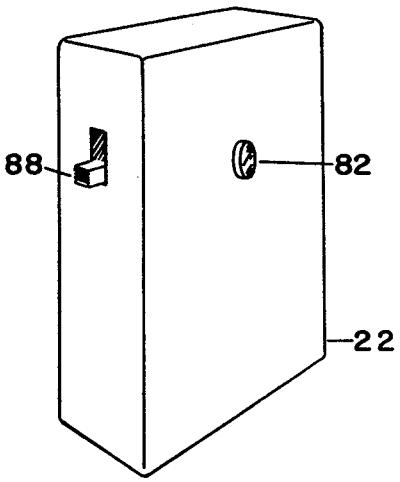
FIG. 5 is a perspective view of the detector box.

The laser optics module 9 consists of a gallium arsenide injection laser 17 and a optical element 18 mounted within a tubular housing 19. The module 9 is fastened alongside the barrel of the weapon in parallel axial alignment with the axis of the bore of the barrel. The optical lens 18 is used to focus the invisible laser pulse of light to a circle of the desired diameter at the prescribed target range. The diameter of this circle may be preselected for a fixed target range or with an optional feature, it can be adjusted to permit the weapon to fire on targets at several different ranges which can be selected individually. The laser pulse which is fired when the trigger is pulled will take on the specific characteristics which would relate to any fired bullet resulting from operator trigger squeeze, muscle fatigue, improper handling and failure to realign on target after initial recoil. As previously indicated the laser electro optic pulser circuitry 40 as shown in FIG. 4 is entirely mounted inside the weapon and with the exception of the laser optic module which is secured alongside the barrel of the weapon there is no indication that the weapon is anything but a standard model.

In the weapon's electro optics circuitry, power is furnished by two 7 volt miniature 160 millampere hour mercury batteries 42 and 44. A battery energization on/off switch 46 and a test input point 48 are located at the butt or handle of the laser weapon. While the basic description of the invention is directed toward the pistol embodiment, the described components can be placed in corresponding parts of a rifle or other weapon. The input test point 48 is included to allow an external pulse train to be inserted for test purposes. Two complimentary metal oxide semiconductor (CMOS) integrated circuits function respectively as (1) a combined trigger switch debouncer 50 and one shot multivibrator 51 and (2) an oscillator 52 whose outputs are rectified in a bridge rectifier circuit 54.

The oscillator 52 is designed to oscillate at 10 Khz. Dual outputs 180° out of phase are coupled through capacitors 55 and 56 to the diodes in the bridge rectifier.

When the trigger switch 5 is activated by pulling the trigger to energize the circuit, the gates **50*a* and 50*b* are connected in a crisscross configuration and prevent any switch bounce from interfering with the circuit operation. The gates connected as a one shot multivibrator 51 produce a narrow negative 50 nanosecond pulse at the output pin 53 of the one shot multivibrator 51 each time the weapon trigger is pulled. The width of the pulse is determined by capacitor 57 and the inherent propagation delay of the CMOS network 50 and 51. However it has no major effect on the final output pulse width and is used as a drive trigger for the circuit. The negative going pulse at the pin 53 of the multivibrator 51 is capacitively coupled by capacitor 59 to the pulser circuit 60 comprised of three transistors 62, 64 and 66. The first transistor 62 acts as an inverter-switch to the pulse and drives the next pair of NPN transistors 64 and 66 into conduction. A capacitor 68 in the collector of the transistor 64 establishes the final pulse width. When transistor 66 is biased on by the pulse it furnishes approximately a 7 ampere current pulse for 200 nanoseconds to the gallium arsenide laser diode 74. The laser 74 radiates a coherent light burst 72 of 200 nanoseconds at 904 nanometers. The burst of light is focused by an optic lens 76** having a focal length of 1.67 cm into a circle of energy at the desired target range.

The accuracy of the circle of energy produced by the laser weapon is uniform for detection and is aligned concentric with the guns bore to approximately 10 times the best firing accuracy. The figures as presented in the present embodiment are set to form an 8 eight inch diameter at 45 feet. It should be noted, that the present invention provides for an adjustable mechanism in the tubular housing 19 for adjusting the focal length of the optic lens to obtain a predetermined beam diameter for any range which may be desired.

In order to have a fair representation of realistic man to man combat with pistols or rifles while utilizing only a single detector on the center of a man's chest, the laser beam should be focused to a circle of the diameter on the order of 20 centimeters. For ranges of 5 meters to 50 meters this necessitates the focusing of the laser optics from a narrow beam of 14 minutes to a wide beam of 2° and 16 minutes of arc. The specifics of the field-of-view as a function of range is listed in the following table.

| RANGE | 2-HALF ANGLE | FOV |
|---|---|---|
| 50 m | 7′ | 14′ |
| 40 m | 9′ | 18′ |
| 30 m | 12′ | 24′ |
| 20 m | 17′ | 34′ |
| 10 m | 34′ | 1°8′ |
| 5 m | 1°8′ | 2°16′ |

What has been done is that the laser, beam is focused to obtain a constant area of 314 square centimeters. Therefore, as the combat range is increased one must narrow the laser beam by adjusting the lens 8 to compensate for this increase in range. For a 2 watt laser this holds the laser irradiance upon the target at a value of 2 watts divided by 314 centimeters. Since this circle is the centermost circle of a Fraunhoffer difraction pattern, the irradiance value must be multiplied by 0.84 which gives the relative amount of energy located in the center ring disc. Thus the power placed on a detector at the target is equal to this irradiant signal times the area of the detector aperture.

Assuming a detector aperture on the order of 0.01 square centimeters, the power on the detector from the laser results in a fairly constant $5.35 \times 10^{-5}$ watts as shown by the following equation:

$$P_{signal} = [2W(0.84)/314\ \text{cm}^2]\,(10)^{-2}\text{cm}^2 = 5.35\,(10^{-5})\,W \quad (1)$$

The previous equation was for a constant size circle with a diameter of 20 centimeters. The current produced by this signal power is determined in the following equation where "ζ" equals the detector's responsivity value.

$$I_s = P_{signal}\,\zeta = 5.35\,(10^{-5})\,W\,(0.45A/W)$$

$$I_s = 2.4\,(10^{-5})\,A. \quad (2)$$

The resultant signal current is shown as being $2.4 \times 10^{-5}$ Amps. The noise in the detector is limited by the signal due to the solar irradiance in the detectors field-of-view. The power of the detector due to this solar irradiance is spectrally dependent and is given in the following equation.

$$P_\lambda = T_o H_s A_{EP} R_f \sin^2 a \quad (3)$$

In the equation $T_o$ is equal to the optics transmission, $H_s$ is the solar irradiance, $A_{EP}$ is the entrance pupil aperture, $R_f$ is the reflectance of the earth field, and "$a$" is the detector's field-of-view half angle. By placing a Band-Pass Filter over the detector, which is centered about 0.9 microns in wave length and 500 angstroms in bandwidth, the detector's efficiency at discerning the laser signal is greatly enhanced. In this band-pass interval the solar irradiance assumes a value on the order $89 \times 10^{-3}$ watts per square centimeter. The detector used is a 160° field-of-view silicon detector. This would render a square sine of the 80° half angle at 0.97 value. As previously stated, the area of the entrance pupil is $10^{-2}$ centimeters squared. Therefore no forward collecting optics are present for the detector. The transmission of the band-pass filter is on the order of 0.45. The earth reflectance can assume an average value of 50%. These values when applied to equation 3 render a spectral power upon the detector on the order of 0.216 milliwatts of value. The DC structure of the solar signal is eliminated so that the detector shot noise is the limiting noise current available. This detector response to the solar induced shot noise is given by equation 4.

$$I_{n\lambda} = (2_q P_\lambda \zeta\, \Delta f)^{\frac{1}{2}} \quad (4)$$

Here, $q$ is the electronic charge given at a value of $1.6 \times 10^{-19}$ coulombs $\Delta f$ is the systems noise bandwidth given at a value of $2.5 \times 10^{-6}$ hertz.

This is derived from the fact that the accepted time-width of signals are 200 nanoseconds CNS which are required to accept the laser pulse width. Applying these values to equation 4, the current in the detector due to the shot noise is given in equation 5 as being 9.3 nanoamps.

$$I_n = 9.3\,(10^{-9})\,A \quad (5)$$

In order to find the detector's signal to noise ratio, to be expected under the facts as listed, the results of equation 2 are divided by the results of equation 5 and as set forth in equation 6 are found to be 2,530.

$$I_s/I_n = 2.4\,(10^{-5})/9.3\,(10^{-9}) = 2530 \quad (6)$$

This shows that there is a comfortable margin over three orders of magnitude of laser signal over high noon, solar irradiance and shot noise.

In the preferred embodiment the detector filter is left out of the system, with the signal-to-noise ratio taking on a value of 46 which is an adequate $s/n$ ratio. Thus the system is further simplified, due to the removal of all spectral filtering.

If the laser beam is focused too sharply for the required range, the signal to noise ratio goes up. However, the probability of a hit decreases beyond a realistic value. As a corollary if the laser beam is at a value too wide for the given range, the detector should pick up the signal but even the poorest of gunmen should be able to register a hit. This problem of constructing hit acceptance can be adjusted to an optimum value by manipulating the detector's threshold logic in order to assure a high probability of detection with a low probability of false alarm. The detector signal to noise threshold is set at a value of 10. With the previously derived signal to noise ratio, this would have from one to two orders of magnitudes of signal to noise which can be manipulated for an optimum configuration per individual application.

A detailed inspection of the detector circuitry as shown in FIG. 6 reveals a 160° silicon photodiode 82 with guard biased with the total power supply voltage of batteries 84 and 86 when activated by switch 88. Receipt of the pulse of light from the laser weapon causes a current change in the photodiode which produces a resultant voltage across the filter network 90 to the input of an operational amplifier 92. However, only a fast rise time laser pulse (which does not exist in nature) is coupled into the current mode connected operational amplifier 92. Thus by being connected in a current mode rather than by a voltage mode, sunlight or artificial light is prevented from triggering the mechanism.

The operational amplifier 92 inverts the pulse and provides either 40 or 80 dB gain by either one or two stages selected for the required application. Further DC isolation at the output of the operational amplifier improves the overall circuit capability to provide gain only for the narrow pulse width produced by the laser weapon. Therefore, no sun filter or either active and/or passive filter circuitry is required. The narrow pulse-width from the operational amplifier 92 is inverted again in the threshold comparator 94. If the received laser pulse is above the value on the other arm 95 of the comparator 94 a negative pulse is produced at the output 96. The threshold comparator 94 does not require any adjustments due to the high noise immunity and fixed threshold level and is set to detect and indicate a hit only by receipt of a pulse of light from the laser weapon.

The "hit" pulse at output 96 of the comparator travels by way of a miniature coaxial cable 98 to a remote hit timer and indicator 100. It should be noted that two detectors can be plugged into the hit timer and indicator 100 at 102, and 104. The narrow negative pulse is processed by a CMOS one shot multivibrator 108. Receipt of the hit pulse switches the cross coupled flip flop 110 and disables any other hit pulses or noise transmission until the timer 112 has completed its cycle. The timer 112 must complete the entire cycle before registering another hit. It should be noted that the resistor 113 and capacitor 115 of the timer 112 can be varied to change current to the timer so that the length of time the indicator stays on can be varied.

The CMOS timer 112 produces a set interval positive pulse which travels to the driver transistor 114 causing the audible horn 116 to sound. Thus the period of the output of the timer 112 determines the length of time transistor 114 will conduct and thus the time that the horn 116 will sound. It should be noted that if desired a light 118 can be substituted for the horn 116. An on/off switch 120 provides DC power from a dual power supply module which operates off batteries 119 or a 115 VAC convenience power outlet.

Thus the input to the circuit will be the output of the detector previously described and the hit indicator module provides a positive error free indication that a true and valid hit by the laser weapon has been registered.

While the preferred embodiment of the invention has been disclosed, it is understood that the invention is not limited to such an embodiment since it may be otherwise embodied in the scope of the appended claims.

What is claimed is:

1. A weapon marksman training system comprising in combination, a barreled weapon adapted to be selectively operated from a number of modes including live fire, laser means mounted to said weapon in parallel axial alignment with the bore of the barrel, laser pulse generating means completely enclosed in said weapon and located remote from said laser means, said laser pulse generating means being electrically connected to said laser means by connecting circuitry, said laser pulse generating means comprising a power source and an electrical circuit connected to said power source, said laser pulse generating means adapted to cause said laser means to generate a burst of coherent light, a target adapted to be used with said laser weapon, said target comprising a housing, sensor means mounted to said housing, said sensor means adapted to produce an electrical pulse when struck by coherent light, circuit means connected to said sensor means adapted to transmit only electrical pulses of a predetermined width and amplitude and indicator means electrically connected to said circuit means to receive said pulses from said circuit means and produce a signal indicating a true hit on said target from said weapon.

2. A training system as claimed in claim 1 wherein said power source is at least one rechargeable battery.

3. A laser pistol simulator system for training in pistol fire against a target comprising:

a. a modified pistol having a handle, trigger and barrel, able to fire ammunition;

b. laser beam transmitter mounted on said barrel and a power source and laser pulser generating circuit means electrically connected together and removeably mounted in said handle remote from said laser beam transmitter;

c. circuit means electrically connecting said laser beam transmitter with said power source and laser pulser generating circuit means contained within said handle and barrel;

d. switch means operable from said trigger for activating said laser beam transmitter in short bursts; and e. target means for sensing a laser beam when the beam strikes said target means; filter means in operative circuit relationship with said target means for passing only electrical pulses of a predetermined width and amplitude; amplifier means in operative circuit relationship with said filter means for amplifying said predetermined electrical pulses; threshold comparator means in operative circuit relationship between said amplifier means and an indicator means for enabling transmission of the pulse output from said amplifier means when it is greater than a predetermined value; and means in operative circuit relationship with said indicator means for indicating when said laser beam strikes said target means.

4. Apparatus according to claim 3 wherein said indicator means is an audio system.

5. Apparatus according to claim 3 wherein said indicator means is a light.

6. A modified weapon and marksman training system comprising in combination, a modified barreled weapon having a butt capable of firing live ammunition including a pulse generating circuit completely enclosed within the butt of a weapon, said pulse generating circuit comprising power source means connected to an electrical circuit positioned remote from but connected to a laser mounted on the barrel of the weapon, said pulse generating circuit being adapted to cause said laser to generate a burst of invisible coherent light; a target adapted to be used with said weapon, said target comprising a sensor, an amplifier connected to said sensor, a threshold comparator connected to said amplifier in operative relationship to sense, electronically filter, amplify and produce an electrical pulse when predetermined narrow pulse widths of invisible coherent light emitted from said modified weapon strike said sensor, and indicator timer means connected to said threshold comparator; said indicator timer means comprising a flip flop, a one shot multivibrator, a timer integrated circuit means and an indicating device operatively electrically connected together for indicating that a true hit has been registered.

7. A modified weapon and marksman training system as claimed in claim 6 wherein, the flip flop is arranged to receive an output signal pulse from the timer integrated circuit means to prevent further pulse receptions until said timer integrated circuit means has completed its cycle said indicator timer circuit means further including a transistor connected in operative circuit relationship with said timer integrated circuit means to produce a signal output of a fixed duration to give an indication that a true hit on said sensor from said weapon has been accomplished.

8. A laser pistol system utilizing a pistol modified for training a live or simulated pistol fire against a target; said system comprising:

a. a conventional pistol frame having a trigger mechanism, barrel, sights, butt and butt grips;

b. a laser optics module mounted to said barrel outside of the bore and aligned with the axis of the bore;

c. a power source, a laser pulser module including circuit means and switch means electrically connected together and mounted in said butt remote from said laser optics module and enclosed by said grips;

d. means electrically connecting said laser optics module with said power source, laser pulser module and switch means;

e. means connected to said trigger mechanism for activating said laser pulser module circuit means and for energizing said laser optics module with said power source;

f. a detector used as a target for sensing a laser pulse when the pulse strikes said detector; and an electronic filter in operative circuit relationship with said detector for passing only a resultant voltage in response to a fast rise time laser pulse, an amplifier in operative circuit relationship with said electronic filter and detector receiving and amplifying said voltage and providing gain only for the narrow fast rise time laser pulse produced by the laser pistol; a threshold comparator for comparing the voltage level of said predetermined narrow pulse width with a fixed threshold value and passing only those pulses that are above the fixed threshold value; said comparator being arranged in operative circuit relationship with said amplifier, electronic filter and detector means; and an indicator means in operative circuit relationship with said comparator, amplifier, electronic filter and detector to receive a pulse from said comparator indicating that said laser pulse had struck said detector.

9. A laser pistol system as claimed in claim 8 wherein said indicator means is an audio system.

10. A laser pistol system as claimed in claim 8 wherein said indicator means is a light system.

* * * * *